United States Patent [19]

Murphy

[11] Patent Number: 4,869,037

[45] Date of Patent: Sep. 26, 1989

[54] WALL CONSTRUCTION

[76] Inventor: John J. Murphy, P.O. Box 886, Valley Forge, Pa. 19481

[21] Appl. No.: 166,747

[22] Filed: Mar. 7, 1988

Related U.S. Application Data

[63] Continuation of Ser. No. 901,747, Aug. 28, 1986, which is a continuation-in-part of Ser. No. 791,254, Oct. 25, 1985.

[51] Int. Cl.[4] ..... E04B 1/60; E04B 1/64

[52] U.S. Cl. ..... 52/238.1; 52/241; 52/746; 52/309.15

[58] Field of Search ..... 52/238.1, 236.3, 241, 52/408, 409, 309.15, 443, 416, 746, 747, 748

[56] References Cited

U.S. PATENT DOCUMENTS

| | | | |
|---|---|---|---|
| 676,183 | 6/1901 | Ferres | 52/478 |
| 1,315,142 | 9/1919 | Mason | 52/272 |
| 1,501,476 | 7/1924 | Cowan | 52/443 |
| 2,139,461 | 12/1938 | Pride | 52/274 |
| 2,540,252 | 2/1951 | Fischer | 52/553 |
| 3,041,219 | 6/1962 | Steck | 52/409 |
| 3,111,787 | 11/1963 | Chamberlain | 52/309.9 |
| 3,121,649 | 2/1964 | Oliver | 52/409 |
| 3,245,185 | 4/1966 | Rowe | 52/238.1 |
| 3,312,585 | 4/1967 | Hamme | 52/516 |
| 3,332,193 | 7/1967 | Elmendorf | 52/309.13 |
| 3,350,257 | 10/1967 | Hourigan et al. | 52/309.15 |
| 3,362,120 | 1/1968 | Warren | 52/746 |
| 3,443,349 | 5/1969 | Mahle | 52/309.13 |
| 3,468,086 | 9/1969 | Warner | 52/746 |
| 3,474,584 | 10/1969 | Lynch | 52/309.13 |
| 3,475,261 | 10/1969 | Ettore et al. | 52/309.13 |
| 3,654,053 | 4/1972 | Toedter . | |
| 3,708,935 | 1/1973 | Kossuth et al. | 52/416 |
| 3,812,635 | 5/1974 | Hala | 52/410 |
| 4,021,981 | 5/1977 | Van Wagoner | 52/309.13 |
| 4,052,831 | 10/1977 | Roberts et al. | 52/309.8 |
| 4,201,025 | 5/1980 | Williamson | 52/746 |
| 4,672,787 | 6/1987 | Murphy | 52/409 |

OTHER PUBLICATIONS

Reprint by Masonry Advisory Council of Article of Pennsylvania Concrete Masonry Association and Delaware Valley Masonry Institute, Inc. entitled "Design Alert #8—Brick Veneer/Steel Stud Design Dilemma", (as presented in Toronto, Canada).

Article entitled "The Masonry Institute Talks About Steel-Studs and Block-Backups".

Sweet's Catalog, Subsection 7.13 "Exterior Wall Insulation & Finishing Systems"; pp. 7.13/Dr through 7.13/Th (with Table of Contents for 7.13), (1982).

Sweet's catalog, Subsection 7.9/Gr., Grace Construction Products Division literature entitled "Bituthene Waterproofing Systems", (1982).

Reprint of article from *The Construction Specifier*/Apr. '84, entitled "Brick Veneer: A Second Opinion", by C. T. Grimm.

*Primary Examiner*—James L. Ridgill, Jr.

*Attorney, Agent, or Firm*—Panitch Schwarze Jacobs & Nadel

[57] ABSTRACT

Panels for the construction of a moistureproof back-up wall around the exterior perimeter of a building adjoining and spaced inwardly from a moisture permeable exterior wall include a substantially rigid, non-load bearing, moisture-permeable core having two opposing major planar outer sides and four side edges connecting the two opposing major outer sides. A moistureproofing material layer is applied completely covering one of the two opposing major planar outer sides of the core and extending continuously from that side of the core beyond one of the four side edges of the core. An adhesive surface is provided facing the core on the extending portion of the moistureproof material layer. A removable strip applied to the adhesive surface protects the adhesiveness of the surface prior to installation. The moistureproofing layer may be a solid, integral flexible sheet of a suitable material such as plastic or metal, an integral layer of a moistureproof material not having sufficient tensile strength to support itself in use, such as an asphalt based material, or a combination of the two.

36 Claims, 4 Drawing Sheets

WALL CONSTRUCTION

This is a continuation-in-part of application Ser. No. 791,254 filed Oct. 25, 1985 and incorporated by reference herein.

BACKGROUND OF THE INVENTION

The invention relates to building construction and, in particular, to a panel for use in constructing moistureproof back-up wall in three wythe perimeter wall construction and the wall provided thereby.

There is presently employed a type of three layer (withe) wall construction in low to mid-rise building (about 10 floors or less) in which a brick, concrete or other water permeable masonry exterior wall is backed up with steel stud mounted drywall covered with a moistureproof barrier. Moistureproof is used to refer to both waterproof and water vaporproof. An interior drywall layer forms the third withe of the construction. The masonry of the exterior wall is typically held to the building by ties extending from the vertical stringers through the drywall backup.

The conventional construction of such moistureproof back-up walls is the erection of a steel frame by mounting U-shaped galvanized steel channels to the facing upper and lower slab surfaces with power driven steel fasteners, mounting galvanized steel studs at regular intervals (typically 16 inches on center) between the floor and ceiling channel members with galvanized sheet metal steel screws and hanging conventional gypsum board panels adjoining one another to the studs by means of galvanized screws or other steel fasteners. The installed gypsum board panels are then typically "damp-proof" by a roofing or damp-proofing mechanic who either attaches a treated felt paper or trowls a damp-proofing mastic material over the exterior facing major planar surfaces of the panels and the joints between the panels. Mastic is perceived to be a more effective moisture barrier although a more expensive treatment than felt paper which is easily torn in mounting and which can separate from the gypsum panels. Masons then follow to install the outermost moisture permeable masonry wall, often puncturing the felt paper or mastic and underlying drywall to install wall ties. A conventional drywall is hung on the interior side of the studs to provide the third wythe.

A significant problem with this type of drywall-back-up construction is the high labor costs, particularly that associated with the application of the "damp-proofing". The mechanics are generally paid a craftsmen wage and the "damp-proofing" must be applied by hand to the entire surface of the installed back-up wall.

Yet another problem associated with the hand applied mastic type damp-proofing systems as currently installed is that no provision is made for eventual deterioration of the mastic between abutting drywall panels. Typically, the mastic is applied as quickly as possible with no special treatment being given to the seams between the adjoining gypsum board panels. The mastic is simply trowelled across the panels and over seams between the panels.

Another problem is that the thickness of the hand applied coating is never uniform. Typically only a minimum thickness is specified for the entire wall and applies to both the mastic supported on the gypsum board surfaces and the mastic supported only by the integrity of the material across the seams. The aging and deflection of the wall under dynamic wind loads on the building endanger the integrity of the moistureproof coating in the seam areas. It is believed that failure of the moistureproofing in the seam areas will be a cause of significant future problems in this type of construction.

SUMMARY OF THE INVENTION

The primary object of the invention is to provide a building panel having a moistureproof coating and at least one side thereof for an improved back-up wall in a three wythe type of exterior wall construction.

It is yet another primary object of the invention to provide a building panel having means to moistureproof the seams which exist between adjoining panels.

It is yet another object of the invention to reduce moistureproof back-up wall construction costs by reducing on-site costs of installing a moistureproof back-up wall.

It is yet another object of the invention to provide an improved moistureproof back-up wall of adjoining panels by providing predetermined moistureproof material thicknesses uniformly over the panels.

These and other objects are satisfied by the wall panel of the subject invention which is provided for building construction and comprises a substantially rigid, a non-load bearing, water permeable core having a pair of opposing, major planar outer sides and four side edges connecting the two opposing major outer side. The panel includes a flexible sheet covering one of the two major sides of the core which also extends continuously beyond at least one of the four side edges of the core. An adhesive layer covers a side of the flexible sheet facing the core adhering the sheet to the one major side of the core and extends beyond the one side edge of the core onto the edge portion of the sheet. A removable protective strip covers the adhesive layer on the edge portion of the sheet until installation.

According to another important aspect of the invention, the flexible sheet extends continuously from the covered one major side of the core beyond a second side edge adjoining the first side edge. In the case of this embodiment, the flexible sheet may overlap the remaining two side edges of the core.

Another important aspect of the invention is that the adhesive layer can also be a moistureproofing sealing layer as well providing two moistureproofing layers of protection.

Another object of the invention is to provide a back-up wall construction of moistureproof panels which provide improved moistureproof sealing in the seams between adjoining panels.

It is yet another object of the invention to provide a moistureproof back-up wall construction requiring less labor than back-up wall construction employing hand applied moistureproofing mastic.

It is another object of the invention to provide a back-up moistureproof wall construction with a more uniformly applied and predetermined moistureproof layer thickness than that which is achievable with hand applied moistureproofing mastic.

According to another aspect of the invention, a vertical moisture-proof back-up wall is provided between a pair of parallel, horizontal, vertically spaced load-bearing slabs near an exterior edge of each of the slabs by providing a frame extending vertically between the spaced slabs and attaching to the frame on an exterior facing side of the frame, between the frame and the exterior side edges of the slabs, a multiplicity of adjoining, non-load bearing panels. Each panel includes a moisture permeable core with a pair of major planar opposing sides, one side facing outward from the slabs and the remaining side facing the frame. A moistureproof sheet covers the one outwardly facing major side of core and extends continuously from that one major side of at least a subset of the panels, overlapping an edge portion of the integral sheet on one or more immediately adjoining panels. In all described embodiments, the adjoining panel overlapped by the sealing layer is below the panel bearing the overlapping sealing layer. In the preferred embodiment at least some of the panels include a second portion overlapping a side edge portion of the one major planar side of a side adjoining panel.

The invention also includes the method of constructing the aforesaid wall.

DETAILED DESCRIPTION OF THE INVENTION

Figure 1:
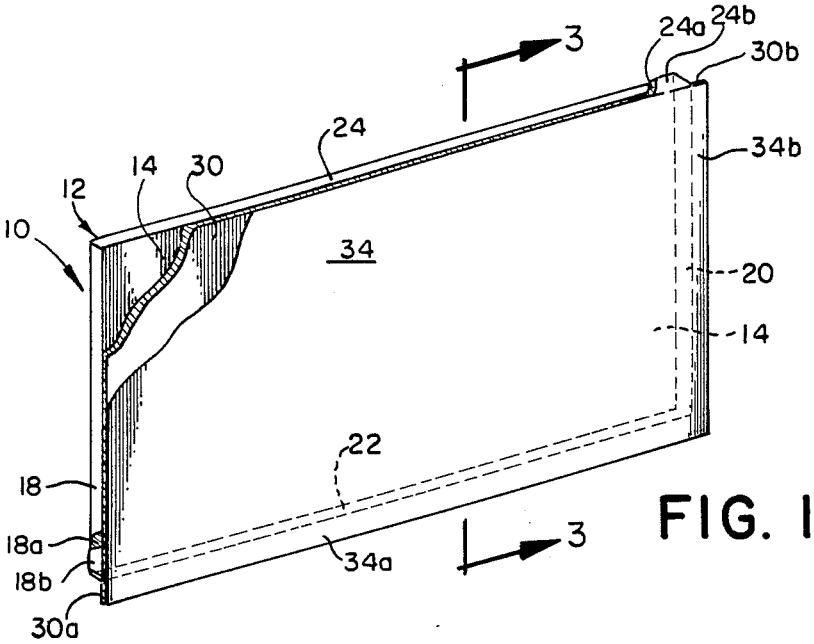
FIG. 1 is a perspective, diagrammatic view of a preferred panel of the subject invention.
Figure 2:
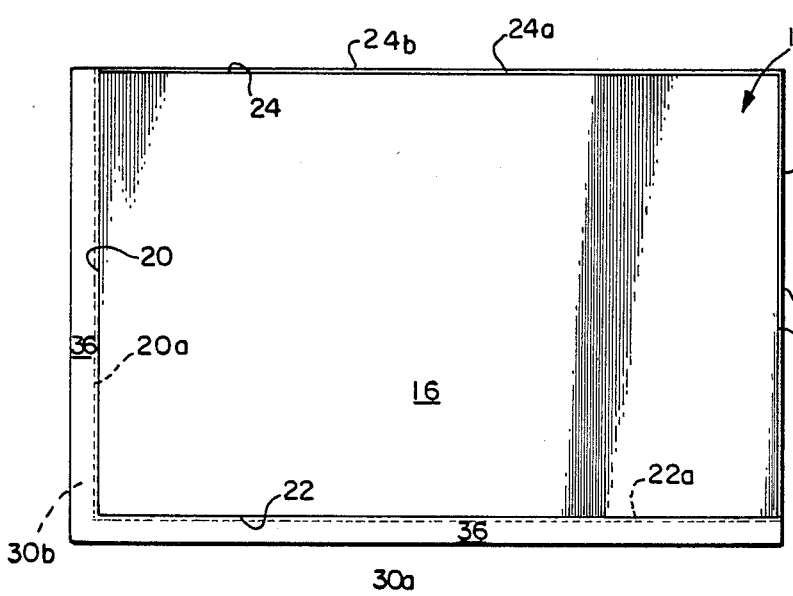
FIG. 2 is a front elevation of the panel of FIG. 1.
Figure 3:
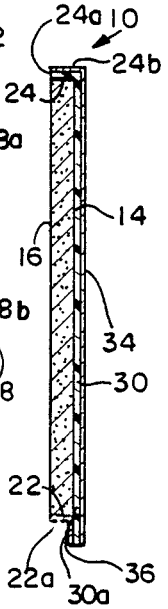
FIG. 3 is a side sectioned elevation of the panel of FIG. 1 along the lines 3—3.

FIGS. 1 through 3 depict a preferred, back-up moistureproof wall panel 10 of the subject invention. The panel 10 includes a substantially rigid, non-load bearing moisture permeable core 12, such as a conventional gypsum wall board panel, having two opposing major planar rectangular outer sides 14 and 16 (both seen only in FIG. 3), two parallel vertical side edges 18 and 20 and two more parallel, horizontal side edges 22 and 24 connecting the opposing major outer sides 14 and 16. A sealing layer 30 of an elastic, moistureproof, self-adhering material covers one major planar side 14 of the core 12. Portions 18*a* and 24*a* of the layer 30 may be extended onto the vertical side edge 18 and horizontal side edge 24, respectively, to moistureproof those edges. A flexible sheet 34 covers the sealing layer 30 and major planar side 14. Edge portions 34*a* and 34*b* of the sheet 34 extend continuously from the one major side 14 beyond the horizontal side edge 22 and vertical side edge 20 of the core. The sheet edge portions 34*a* and 34*b* support portions 30*a* and 30*b* of the sealing layer 30 also extending continuously beyond those side edges from side 14 of the panel. If desired, portions 18*b* and 24*b* of the flexible sheet can be extended over the sealing layer portions 18*a* and 24*a* on core side edges 18 and 24, respectively, as well. A removable, protective strip 36 (see FIGS. 2 and 3) covers the core facing, self-adhering surfaces of the sealing layer portions 30*a* and 30*b* extending beyond the vertical and horizontal edges 20 and 22, respectively. The protective strip sheet 36 may be a continuous L-shaped strip as depicted in FIG. 2 or a pair of abutting vertical and horizontal strips (not depicted). The purpose of the protective strip 36 is to protect the adhesive surface of the overhanging portions 30*a* and 30*b* of the sealing layer 30 by preventing them from adhering to other parts of the panel 10 or to other objects and by preventing dirt and the like from adhering to the surface thereby maintaining and preserving the adhesive character of the surface of the sealing layer portions 30*a* and 30*b* before the panel is installed. If desired, separate portions of the sealing layer 30 or of the sealing layer 30 and sheet 34 may also be applied to cover the vertical and horizontal side edges 20 and 22, respectively, of the panel 10. In addition, instead of continuing the portion of the layer 30 or the layer 30 and the flexible sheet 34 from the major planar surface 14 onto the side edges 18 and 24, those side edges or all four side edges 18, 22, and 24 may be covered by separate strips of the same material(s). The strips of sealing layer 30 or sealing layer 30 and flexible sheet 34, which are optionally provided to cover the vertical and horizontal two side edges 20 and 22, respectively, are indicated in phantom in FIGS. 2 and 3 as 20*a* and 22*a*.

It is envisioned that panels 10 preferred for having superior moistureproofing capacity are inexpensively constructed by applying to a conventional rectangular gypsum drywall panel, an elastic, moistureproof material which is sufficiently adhesive to self-adhere to the gypsum wallboard or other core used and a covering thin solid sheet of another moistureproof material such as plastic film or metal foil. A material envisioned to be ideal for this purpose includes a primary layer of rubberized asphalt integrally bonded to a polyethelene plastic film sheet and is sold by Grace Construction Products under the names Bituthene® and Ice & Watershield TM. The latter is supplied in continuous sheets 40 mil. thick while the former is supplied in continuous sheets 60 mil. thick. Its envisioned that the latter or an even thinner comparable system would be sufficient for the purposes of the subject invention. The rubberized asphalt layer of these products is sufficiently adhesive to adhere the product to gypsum wallboard panel. A peelable protective sheet supplied with both of these materials can be used for the removable protective strip 36.

Figure 4:
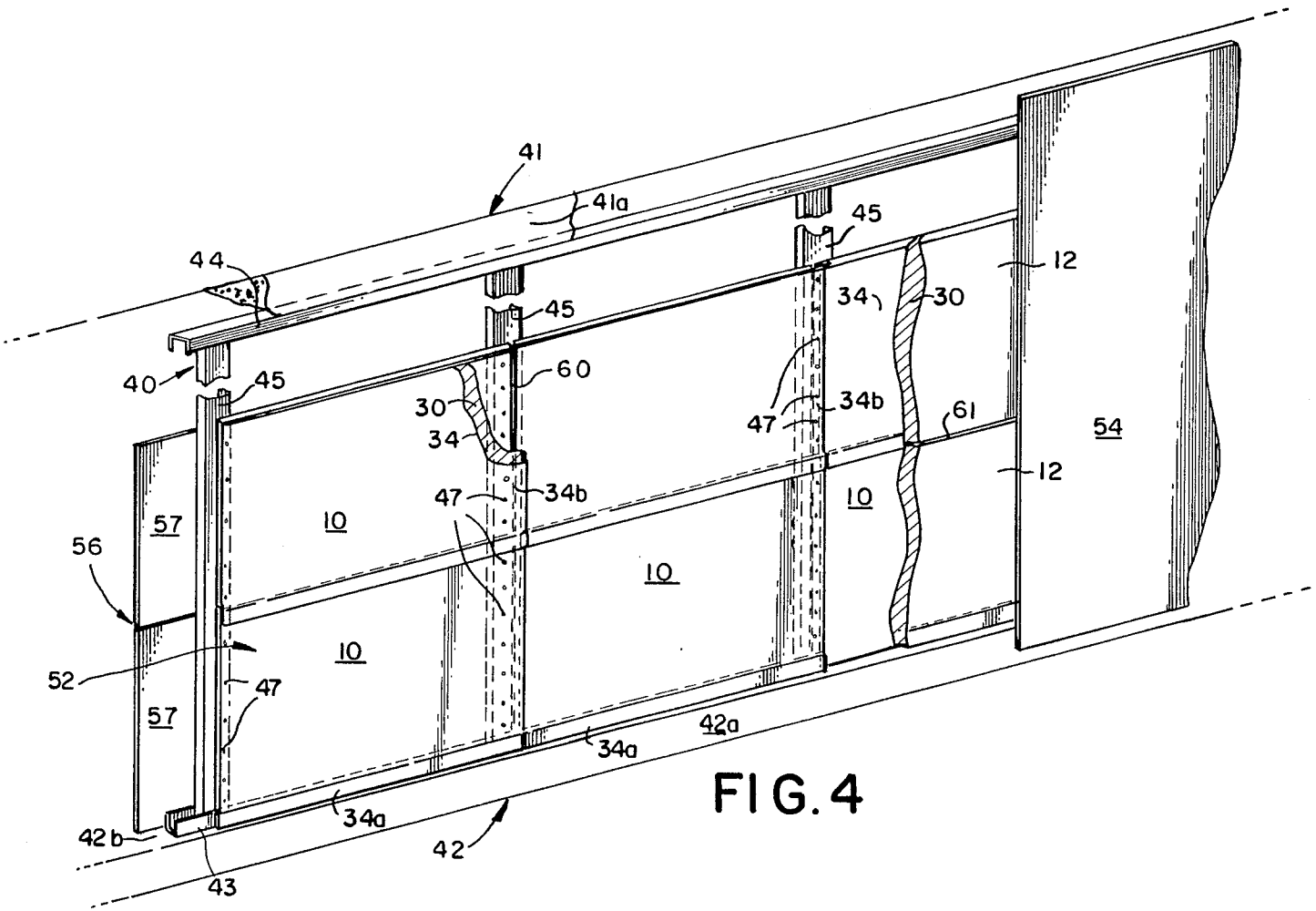
FIG. 4 is a diagrammatic wall construction illustrating the use of the panels of FIGS. 1 through 3.

FIG. 4 depicts diagrammatically a vertical, moistureproof back-up wall constructed with the panels 10 of FIGS. 1–3. A vertical frame 40 is constructed between parallel, horizontal, vertically spaced, load-bearing slabs 41 and 42 by the attachment of U-shaped channel members 43 and 44 to the top surface of lower slab 42 and bottom or ceiling surface of upper slab 41, respectively, near exterior side edges 41*a* and 42*a* of the slabs, and inserting into the channels 43 and 44 at regularly spaced intervals, vertical metal stringers or studs 45 extending between the slabs 41 and 42. A multiplicity of the preferred embodiment panels 10 adjoining one another are attached, to the outer facing side of the vertical stringers 45 between the frame 40 and the exterior edge of the slabs 41 and 42. The panels 10 are attached to the stringers 45 by conventional means such as galvanized machine screws 47 passed through the panels 10 and into the studs 45. To minimize the chances of breaking the moistureproof seal, it is preferred that the sealing layer 30 be of a sufficient elasticity and thickness to surround axial portions of fasteners like the machine screws 47 typically used in such construction to attach the panels and wall ties to the frame, to form a moistureproof seal with the axial portions of those fasteners passing through the sealing layer to prevent moisture penetration through the sealing layer 30 into the cores 12. The studs 45 and channels 43 and 44 are typically galvanized steel and held together by conventional means such as galvanized machine screws. The panels 10 of the invention are installed right to left adjoining one another in a first horizontal row adjoining the lower slab 42 and right to left adjoining one another in a second horizontal row over the first row. The lower overhanging portions 34*a* of the sheet 34 of each of the first (i.e. lower) row of panels 10 is self-adhered to the upper surface 42*b* of the lower slab 42 and outer side of channel 43 by the underlying sealing layer 30*a*. The side overhanging portion 34*b* of the sheet 34 of each panel 10 and underlying sealing layer 30*b* is applied over the sealing layer 30 and sheet 34 of a right side adjoining panel. In this way, virtually all vertical seams between side by side adjoining panels and all horizontal seams between over-under adjoining panels 10 are sealed by the sealing layer and sheet of an adjoining panel 10. The left side edge of the leftmost panels 10 in the wall can be sealed against either an adjoining similar wall intersecting with this wall by the extension portions of flexible sheet and sealing layer of the panels of that wall or with a structural member at the corner of the building by a vertical strip of an adhesive moistureproof material overlapping the side edge portion of those panels and the adjoining structural member. The space between the uppermost panels 10 and the bottom surface of the upper slab 41 can be finished by conventional means such as a soffet provided with breathing holes, or, if total sealing is desired, by an elongated strip of the adhesive material strip run horizontally overlapping the upper edges of the top most row of panels 10 and a portion of the bottom surface of the upper slab 41. The sealing material layer 30 and flexible sheet 34 have been cut away from the right edge of the upper panel 10 of the left most pair of panels and the right edge of the right most pair of panels 10 in FIG. 4 showing the location of the gypsum board cores 12 and the vertical seams 60 between side-by-side adjoining and the horizontal seams 61 between top by bottom adjoining ones of the panels 10 which are overlapped by the sealing layers 30 and flexible sheets 34. After construction of this middle, moistureproof back-up wall, indicated generally by reference numeral 52, a moisture permeable exterior wall, represented schematically up by panel 54 is constructed along the exterior side of the building extending between the slabs 41 and 42. The panel 54 adjoins but is spaced from the major planar side (14) of the back-up wall panels 10 bearing the sealing layer 30 and sheet 34. The exterior wall which may be a concrete or other ceramic prefabricated panel or a row of laid brick. Once the moistureproof wall 52 is in place, an interior finished wall, represented generally by reference numeral 56, can be fabricated from conventional gypsum wallboard panels 57 mounted in a conventional fashion to the opposing, interior facing side of the vertical stringers 45.

Figure 5:
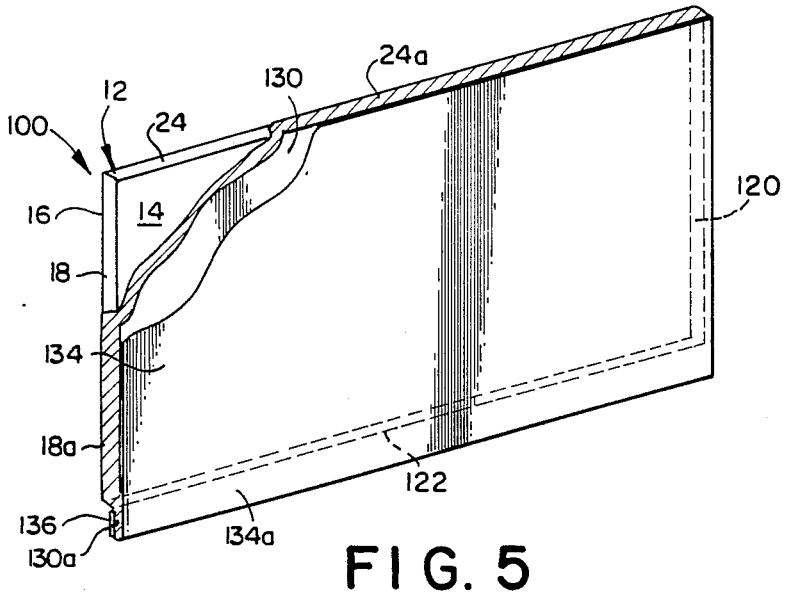
FIG. 5 is another panel embodiment of the invention.
Figure 6:
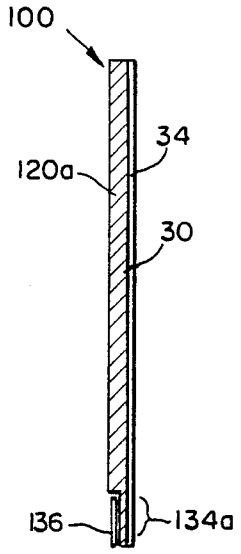
FIG. 6 is a view of the right side of the panel of FIG. 5.

FIG. 5 depicts a second embodiment 100 of the invention which again includes a substantially rigid, nonload bearing, moisture permeable core member 12 having a pair of major opposing planar, parallel rectangular outer sides 14 and 16 connected by a pair of vertical, parallel side edges 18 and 20 and a pair of horizontal parallel side edges 22 and 24. A sealing layer 130 of an elastomeric, moistureproof self-adhering material is again applied to the major planar surface 14. Portions 18*a* and 24*a* of the layer continue from the major planar side 14 and on to the side edges 18, and 24, respectively. As seen in FIG. 6, a similar portion 120*a* of the layer 30 continues onto the remaining side edge 20. Adhered to the layer 30 over at least a major planar surface 14 is a flexible sheet 34 of a non-adhesive moistureproof material such as plastic film or metal foil. A portion 134*a* of the sheet 34 extends beyond the lower side edge 22, which is one of the two longer side edges of the core 12, and supports sealing layer portion 130*a* which is also continuous with the portion of the sealing layer 130 adhering to the core surface 14. A removable protective sheet 136, which only lightly and removably adheres to the layer 130, is provided on the side of the portion 130*a* opposite the flexible support sheet portion 134*a*. Again, if the panel 100 is manufactured from a material such as the aforesaid Bituthene TM or Ice & Water Shield TM which include a rubberized asphalt sealing layer adhered to a flexible plastic sheet, then the flexible sheet 134 can easily be extended over the side edges 18, 20 and 24 of the panel 12, as well.

Figure 7:
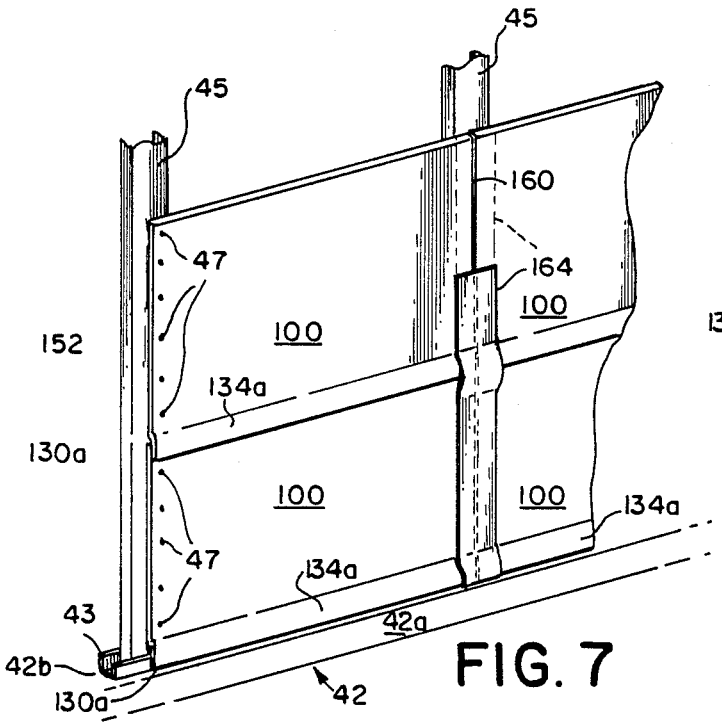
FIG. 7 is a diagrammatic depiction of the use of the panel of FIGS. 5–6 in the construction of a moistureproof back-up wall.

FIG. 7 depicts a portion of a moistureproof back-up wall 152 formed from the panels 100 of FIG. 5. The panels 100 are again mounted by suitable means such as machine screws 47 to vertical stringers 45 in a frame extending from an upper surface 42*b* of a first slab 42 to the ceiling surface of a parallel, higher slab (not depicted) near an exterior edge 42*a* of the slab. The panels 100 are mounted side by side and over and under adjoining. The extension portions 130*a* and 134*a* of the sealing layer 130 and flexible sheet 134 of the upper panel overlaps the top edge portion of the panel 100 directly beneath it. The extension portions 130*a* and 134*a* of the lowermost row of panels 100 is self-adhered to the floor surface 42*b* of the supporting slab 42 and/or channel section 43. The vertical seams 160 between side by side adjoining panels 100 are closed by an overlapping strip 164 partially indicated in phantom, of the aforesaid sealing layer and cover sheet material which self-adhers to the cover sheet of the mounted panels 100 overlapping their adjoining side edge portions. Top and side treatment of the wall 152 are as previously disclosed. The wall 152 again backs up a moisture permeable masonary exterior wall and protects a conventional gypsum board drywall (both omitted) on the opposing sides of the vertical stringers 45.

While the preferred embodiments use a rubberized asphalt layer or other comparable elastomeric, moistureproofing adhesive material layer to adher a flexible moistureproof sheet to the surface of the gypsum board panel forming the core of the panel, other adhesive materials, notably, any of a variety of plastic adhesive materials, could be applied in a thin layer to adhere the flexible moistureproof sheet to the major planar side of the core as well as to adher the edge portions of the flexible sheet to the adjoining panels. It will be appreciated that such adhesive layers will not have the moistureproofing capability that the suggested rubberized asphalt material has. Such panels are likely to be less expensive to construct but would provide somewhat less insurance of long-term moistureproofing protection. and cannot guarantee gasketing around fasteners passed through the flexible sheet and panel. It is further envisioned that such adhesives would be selected so that they might also be used with compatable peel-away or otherwise easily removable protective strips and may also be used by themselves or to adhere a plastic film sheet to the narrow side edges of the core for waterproofing those edges.

Moreover, while the preferred embodiments include a rubberized, self-adhering moistureproofing material to joining a moistureproof integral plastic film flexible sheet to a supporting core, a moistureproofing adhesive material layer may be applied to a moisture-permeable, flexible supporting layer in any of the configurations previously described to provide a single layer of moistureproofing protection over the panel cores and the seams between the adjoining panels. Again, the moistureproofing adhesive material sealing layer should be of a sufficient elasticity and thickness to surround fasteners like machine screws to form a moistureproof seal with the axial portions of those fasteners and/or ties passing through the layer to prevent moisture penetration through the sealing layer.

In addition to gypsum board, the cores 12 of the embodiments of FIGS 1 through 3 and 5–6 can be of an insulative material such as conventional substantially rigid, non-load bearing foamed or expanded urethane, styrene or isocyanurate or glass fiber sheathing, board or panel, each available from any of a number of commercial manufacturers and suppliers. The former materials are preferred as being substantially waterproof themselves, thereby contributing to the moistureproof integrity of the back-up wall.

the insulated cores should have a thermal resistance value ("R " value or factor) per inch of thickness greater than that provided the gypsum board products typically used in fabricating back-up walls. The thermal resistance value of each of the insulating materials previously mentioned is typically on the order of about four or more per inch of thickness. This compares with a thermal resistivity of significantly less than about four per inch of thickness for gypsum wall board and other types of sheeting conventionally employed in the construction of such back-up walls.

Figure 8:
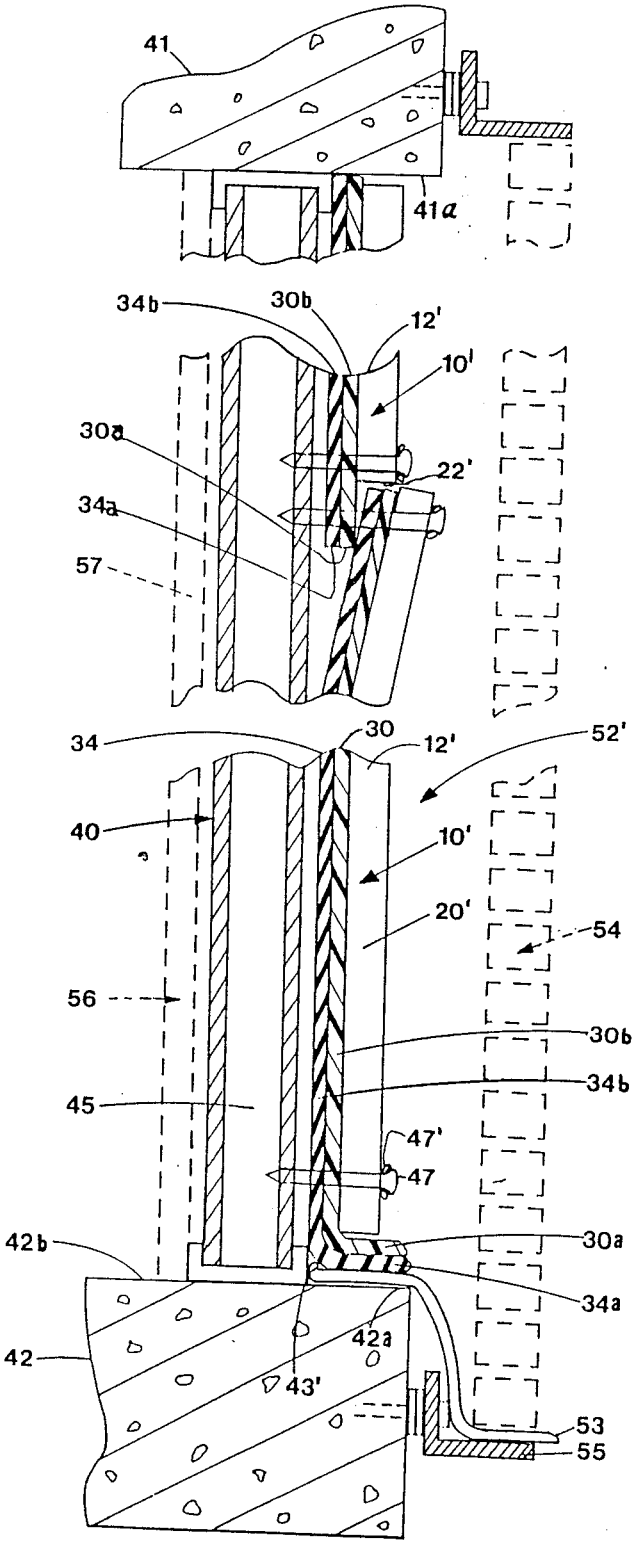
FIG. 8 is a diagrammatic depiction of the use of the panel of FIGS. 1–3 in the construction of an alternate configuration moistureproof back-up wall.

When an insulated core 12' is used, a different construction for the back-up wall is suggested. A back-up wall construction presently preferred using insulated panels 10' of the present invention is depicted diagrammatically in cross-section in FIG. 8. The construction is substantially identical to that in FIG. 4. A frame 40 extends between a pair of adjoining, horizontal, load bearing, slabs 41 and 42 of the building. A back-up wall 52' is erected using panels 10' of the subject invention each with an insulated core 12', an elastic moistureproof sealing layer 30 and flexible sheet 34. The panels 10', are mounted on a side of the frame 40 adjoining and facing an exterior side edge 41a and 42a each of the slabs and an outer, moisture permeable wall 54 (indicated in phantom) of concrete, masonry, etc. of the building which is exposed to the elements. A finished interior wall 56 (also in phantom) of conventional gypsum board panels 57 is erected on an interior side of the frame 40. The back-up wall 52' of FIG. 8 differs from the wall 52 of FIG. 4 in that the panels 10' are reversed so that the flexible plastic sheet 34 and elastic moistureproof sealing layer 30 face and abut the vertical stringers 45 of the frame 40 while the insulative cores 12' are located on the exterior side of the resulting back-up wall 52' facing the adjoining outer wall 54. In this way, the flexible sheet 34 and elastic moistureproof sealing layer 30 are positioned between the cores 12' and the frame 40. The purpose of this arrangement is to keep the insulation and hence dew point outside the frame so that moisture is not likely to condense within the frame causing corrosion problems. Again, the sealing layer and flexible sheet may be the aforesaid Bituthane TM or Ice & Water Shield TM products or other similar products. If necessary, any primers or sealants suggested by the manufacturer (s) for applying the sealing layer (or flexible sheet) to the particular core material employed should also be used.

The cores 12', of the panels 10' are planar, substantially non-load bearing insulative panels of any of the types previously mentioned. While not specifically indicated, it is suggested that a moistureproof material like the sealing layer material be wrapped around or separately applied to the sides edges of the course 12' to help close and seal the joints formed between the panels when erected. Again, conventional fasteners are used to attach the panels 10' to the vertical stringers 45. These can be machine screws 47 conventionally used to attach gypsum board and other paneling to such stringers or special insulated fasteners sometimes suggested for use with the foregoing insulated cores. It is further suggested that O-ring type weatherproof gaskets 47' be used beneath the heads of the fasteners passed through the panels 10' to attach wall ties to the frame 40, divorce the metal of the wall ties from that of the frame and fasteners thereby preventing electrolysis between the ties and the other metal.

Again, first portions **30*a* and 34*a* of the sealing layer 30 and solid flexible sheet 34, respectively, of each of an upper row of the panels 10' extend continuously and unbrokenly from a major planar side of each of those panels facing frame 40 beyond the longer, lower side edge 22' of those panels and overlap the flexible solid sheet 34 of the immediately below-adjoining panels. Similarly, the second portions 30*b* and 34*b* of the sealing layer 30 and flexible solid sheet 34 extend continuously and unbrokenly from the major planar side 14 beyond a narrower side edge 20' of each panel 10' (i.e. out of FIG. 8). The portions 30*b* and 34*b* overlap the flexible, solid sheet 34 of a side adjoining panel (not depicted) if one adjoins, or is attached to any other vertical member adjoining the panel on that side of the panel. Preferably the panels 10' of the lowermost row are also provided with downwardly extending portions 30*a* and 34*a* of the sealing layer 30 and flexible solid sheet 34, respectively, which are turned beneath the core 12' and along the upper surface 42*b* of the lower slab 42 and attached to that upper surface with a layer of moistureproofing mastic 43' compatible with the flexible solid sheet and the concrete surface of the floor slab 42. These include, for example, asphalt, epoxy, rubber, synthetic resins and other plastic based waterproof mastics typically used to attach moistureproof plastic sheeting or metal flashing to concrete or masonary foundations decks and roofs or to each other. If the, turned portions 30*a* and 34*a* of the lowermost row of panels 10' do not reach the edge 42*a* of the lower slab 42, preferably they are attached to flashing 53 which does extend beyond the outer edge 42*a* of the lower slab 42 and, preferably, over ,angle iron 55 to direct water away from the base of the wall 52'. If the seam between the lower slab 42 and the back-up wall 52' is not sealed in this way, the lower edge of the back-up wall 52' is suggestedly sealed in a moistureproof manner by a head or layer of sealant against the seam. The side edges of the wall 52' also are sealed to a slab supporting post of the building or any other vertical member to which the back-up, wall 52' laterally extends. The top portion of the wall 52' is sealed to the lower surface of the upper slab 41. The wall 52' is also similarly sealed by panel flaps or by separate applications of moistureproof strip material (e.g. the Bituthane TM sheet) and/or moistureproof mastic where it abuts or receives window sills, jambs, heads, expansion and control joints, piping, ducting, etc. The wall 52' is thus sealed at all of its sides and across its face to form part of a moistureproof inner envelope within the outer walls 54 of the building protecting the interior of the building from moisture passing through the outer walls 54 and preventing loss of the internal air to the outside. Similar complete sealing is suggested for the walls of FIGS. 4 and 7** and any other back-up walls used in this type of construction.

Another aspect of the invention is a transporatable back-up wall assembly formed by a frame, such as the frame 40, having two major opposing outer sides, adapted for being secured between a pair of horizontal, adjoining, vertically spaced, load-bearing slabs of a building and supporting a substantially non-load bearing, non-masonry, non-concrete, non-metal and non-glass moistureproof back-up wall 52, 52' or 152, covering one of the major outer sides of the frame. The frame is further adapted for supporting an inner finished wall on the remaining major outer side. The transportable back-up wall assembly is built as a unit, moved into position and installed between a pair of horizontal, vertically spaced adjoining load-bearing slabs of a building adjacent an exterior edge of each of the slabs. The substantially non-load bearing moistureproof back-up wall extends vertically between the adjoining horizontal load bearing floor slabs 41 and 42 and horizontally between posts, adjoining back-up walls, window inserts or other vertical components. The transportable wall assembly preferably is provided with flexible sealing tabs extending from the perimeters of the assembly and around any openings in the back-up wall provided for receiving piping, tubing, windows, etc. Preferably, the tabs would be continuous portions of an unbroken moistureproof sealing layer of the back-up wall on the frame. Alternatively, the tabs could be separate pieces of material or eliminated in favor of material inserted into or over the joints formed between the perimeter edges of the transporatable wall assembly and the adjoining slabs or vertical members between which the assembly laterally extends. The channel members 43 and 44 of the frame 40 would be attached to the adjoining slabs 41 and 42 in a conventional fashion including the use of explosive fasteners. Alternatively, special fastening systems known to those skilled in this art for mounting outer wall panels, such as, for example the system disclosed in U.S. Pat. No. 3,245,185 incorporated by reference herein, can be employed. A finished, substantially non-load bearing inner wall 56 is thereafter erected in a conventional fashion on the inner web of the stringers 45 (see FIG. 8) defining the inner major side of the frame 40 distal to the edges of the slabs. Again, in a conventional fashion, the transportable wall itself is installed so that the back-up wall adjoins and is spaced inwardly into the building from an outer, moisture permeable wall.

If the wall construction of FIGS. 4 or 7 is used with non-insulative cores 12, it is suggested that any wall insulation provided be positioned between the back-up wall and the outer wall to move the dew point out from within the back-up wall frame.

Although preferred and other embodiments have been described and modifications to them suggested, other modification will occur to one of ordinary skill in the art. Therefore, the invention is not limited to the particular configurations and instrumentality shown but is defined by the accompanying claims.

We claim:

1. In building construction, a vertical, moisture proof, back-up wall mounted on a frame extending between a pair of horizontal, vertically spaced, load-bearing slabs, along an exterior edge of each of the slabs, the back-up improved wall comprising:

a multiplicity of adjoining, substantially non-load bearing panels attached to the frame between the frame and said exterior side edge of each of the slabs, each panel including a substantially rigid moisture permeable core having a pair of major planar opposing sides, one major planar side facing the exterior side edge of each of the slabs and the remaining major planar side facing the frame, and a moistureproof integral layer completely covering the one major planar side of each of the cores; and the integral layers of at least a subset of the panels extending continuously from the one major side of each subset panel and overlapping an edge portion of the integral layer covering each of one or more of the panels immediately adjoining the subset panel.

2. The back-up wall of claim 1 wherein the integral layer of each of the subset panels overlaps an edge portion of only one immediately adjoining panel.

3. The wall of claim 1 wherein the integral layer comprises: a flexible sheet of moistureproof material; and a sealing layer of an elastomeric, moistureproof material between the core and the flexible sheet of each panel, the sealing layer having a thickness and elasticity sufficiently to surround and form a moistureproof seal with axial portions of fasteners passing through the sealing layer, the sealing layer of each of the subset panels extending continuously and integrally from each of the subset panels with the flexible sheet, and the sealing layer overlapping and adhering to only the edge portion of the flexible sheet covering each of the one or more panels immediately adjoining the subset panel.

4. The wall of claim 1 wherein the integral layer of each of the subset panels overlaps one immediately adjoining panel on a lateral side of the subset panel.

5. The wall of claim 4 wherein the integral layer of each of the subset panels overlaps an edge portion of each of at least two panels immediately adjoining the subset panel.

6. The wall of claim 1 in combination with a moisture permeable exterior building wall adjoining and spaced from the one major side of the multiplicity of panels.

7. The walls of claim 6 in combination with a gypsum wallboard panel wall adjoining and spaced from the remaining major planar side of the multiplicity of panels.

8. A method of constructing a vertical, moistureproof back-up wall between a pair of horizontal, load-bearing slabs, along exterior side edge of each of the slabs comprising the steps of:

erecting a frame extending vertically between the pair of slabs;

attaching to a side of the frame facing said exterior side edges of the slabs, a multiplicity of adjoining, substantially non-load bearing panels, each panel including moisture permeable core with a pair of opposing major planar sides, one major planar side of each core facing said exterior side edges of the slabs and a remaining major planar side facing the frame, each core bearing on the one major planar side a continuous layer of a moistureproof material covering the one major planar side of the core; and overlapping a portion of the continuous layer of each of at least a subset of the multiplicity of panels over the continuous layer covering the one major side of a one or more of panels immediately adjoining the subset panel.

9. The method of claim 8 wherein said overlapping step comprises overlapping the edge portion of an immediately adjoining panel beneath each subset panel.

10. The method of claim 8 further comprising the step of adhering the layer to the one major side of each core before the attaching step.

11. The method of claim 8 further comprising the step of erecting a moisture permeable exterior building wall adjoining and spaced from the one major planar side of the multiplicity of panels.

12. The method of claim 11 further comprising the step of erecting a gypsum wallboard panel wall adjoining and spaced from the remaining major planar side of said multiplicity of adjoining panels.

13. A moistureproof, substantially rigid, non-load bearing wall panel for building construction comprising:

a substantially rigid, non-load bearing core having two opposing, major planar outer sides and a plurality of side edges connecting the two opposing major outer sides; and a moistureproof, elastomeric, sealing layer adhered to one of the two major planar outer sides of the core, completely covering and moistureproofing the one major planar outer side, the sealing layer having a thickness and elasticity sufficient to surround and form a moistureproof seal with axial portions of fasteners passing through the sealing layer.

14. The panel of claim 13 further comprising:

a first portion of the sealing layer extending continuously and unbrokenly from the one major planar outer side of the core beyond one of the four side edges of the core;

an adhesive surface on the first portion of the sealing layer; and removable strip means covering the adhesive surface for protecting the adhesive surface prior to use.

15. The panel of claim 13 wherein the sealing layer is an asphaltic composition.

16. The panel of claim 13 wherein the sealing layer is a rubberized composition.

17. The panel of claim 13 wherein the core has a thermal resistance value of about 4 or more per inch thickness of the core.

18. The panel of claim 13 wherein the sealing layer has a thickness of about 0.03 inches more.

19. The panel of claim 13 further comprising a moistureproof, flexible sheet adhered with the sealing layer completely covering the sealing layer and the one major planar side of the core underlying the sealing layer.

20. The panel of claim 14 wherein the sealing layer and flexible sheet have a combined thickness of about 0.04 inches or more.

21. The panel of claim 13 further comprising:

a first portion of the sealing layer extending continuously and unbrokenly from the one major planar outer side of the core beyond one of the four side edges of the core; and a second portion of the sealing layer extending continuously and unbrokenly from the one major planar outer side of the core beyond a second side edge of the core.

22. The panel of claim 21 wherein the first and second portions of the sealing layer extend beyond adjoining side edges of the core.

23. In building exterior wall construction including a moisture permeable outer wall exposed to the elements and a moisture resisting, back-up wall adjoining and spaced into the building from the outer wall and supported on a frame extending between a pair of horizontal, vertically spaced, load-bearing slabs, the improved back-up wall comprising:

a plurality of adjoining, substantially rigid, non-load bearing planar cores attached to the frame between the frame and the outer wall, each core having a pair of opposing major planar sides and a plurality of side edges connecting the pair of opposing major planar sides, a first major planar side facing the outer wall and a second major planar side facing the frame;

a moistureproof sealing layer completely covering one major planar side of at least one of the cores; and a flexible sheet adhered with the sealing layer and covering sealing layer and the one major planar side of the one core underlying the sealing layer.

24. The improved, back-up wall of claim 23 further a separate sealing layer adhered with one major planar side of each core; and a separate moistureproof flexible sheet adhered with each separate sealing layer covering the one major planar side of each core underlying the sealing layer; and wherein portions of each adhered together sealing layer and moistureproof flexible sheet covering the one major side of each core extend continuously and unbrokenly from the one major planar side of each core beyond at least one side edge of the core.

25. The improved, back-up wall of claim 23 wherein the one core has a thermal resistance value of about four or more per inch of thickness of the core and the one major planar side is the second major planar side of the one core facing the frame.

26. The improved, back-up wall of claim 23 wherein the one core is water permeable and the one major planar side of the one core is the first major planar side facing the outer wall.

27. The improved back-up wall of claim 23 wherein one major planar side of each core is covered with a sealing layer having a thickness and elasticity sufficient to surround and form a moistureproof seal with axial portions of fasteners passing through the sealing layer and a flexible sheet adhered with the sealing layer covering the sealing layer and the one major planar side of the core underlying the sealing layer.

28. The improved, back-up wall of claim 23 further comprising at least a first portion of the sealing layer and a first portion of the flexible sheet each extending continuously and unbrokenly from the one major planar side of the one core beyond at least a first side edge of the one core, overlapping at least part of at least a second core immediately adjoining the one core and moistureproofing a joint between the adjoining first and second cores.

29. The improved back-up wall of claim 28 wherein the sealing layer has a thickness and elasticity sufficient to surround and form a moistureproof seal with axial portions of fasteners passing through the sealing layer.

30. The improved, back-up wall of claim 29 wherein the sealing layer and the adhered flexible sheet extend continuously and unbrokenly from the one major planar side of the one core beyond at least a second side edge of the one core, overlapping at least part of a third core immediately adjoining a lateral side of the one core and moistureproofing saidjoint between the one core and the third core.

31. A building exterior wall construction including the erection of a vertical moistureproof back-up wall between a pair of horizontal, vertically spaced, load-bearing slabs, along an exterior edge of each of the slabs, comprising the steps of:

erecting a frame extending between the pair of adjoining slabs and adjoining and spaced inwardly into the building from the exterior edge of each of the slabs; and securing to the frame on a side of the frame proximal the exterior edges of the slabs, a plurality of moistureproof panels, each panel including a substantially rigid, non-load bearing planar core having a pair of opposing major planar sides and a plurality of side edges connecting the pair of opposing major planar sides, each core having a moistureproof sealing layer completely covering one major planar side of each core and a flexible sheet adhered with the sealing layer covering the sealing layer on the one major planar side of each core.

32. The method of claim 31 wherein the panels are installed with the flexible sheet and sealing layer positioned between the frame and each core.

33. The method of claim 31 wherein a portion of the sealing layer and a portion of the flexible sheet on one panel extend from the one major planar side of the one panel beyond a side edge of the one panel and further comprising the step of adhering the portion of the sealing layer to a second panel adjoining the one panel thereby covering and moistureproofing a seam formed between the one panel and the second panel.

34. The method of claim 31 wherein each sealing layer has a thickness and elasticity sufficient to surround and form a moistureproof seal with fasteners passing through the sealing layer and wherein the securing step comprises passing fasteners through the flexible sheets and sealing layers to secure the panels to the frame.

35. A prefabricated, transportable, back-up wall assembly comprising:

a frame having two major opposing sides and adapted for being secured between a pair of horizontal, adjoining, vertically spaced, load-bearing slabs of a building supporting a substantially non-load bearing, moistureproof back-up wall and an inner finished wall extending between the slabs on opposing sides of the frame; and a substantially rigid, non-load bearing moistureproof back-up wall support by and covering one of the major opposing sides of the frame, the wall including sealing layer means covering a side of the wall and moistureproofing the side of the wall, the sealing layer means having a thickness and elasticity sufficient to form a moistureproof seal with axial portions of fasteners passing through the sealing layer.

36. In building exterior wall construction, the improved method of erecting a moistureproof back-up wall along an exterior edge of the building adjoining and spaced inwardly into the building from an outer, moisture permeable outer wall of the building exposed to the elements, comprising the steps of:

fabricating a transportable back-up wall assembly including a frame having two major opposing sides and a substantially non-load bearing moistureproof wall covering one major side of the frame, the frame of the assembly being adapted for being secured between a pair of horizontal, adjoining, vertically spaced, load-bearing slabs of a building, supporting the substantially non-load bearing moistureproof wall and for supporting an inner finished wall on the other major opposing side of the frame, the wall including sealing layer means covering a side of the wall and moistureproofing the side of the wall, the sealing layer means having a thickness and elasticity sufficient to form a mostureproof seal with axial portions of fasteners passing through the sealing layer; and positioning and securing the transporatable back-up wall assembly between a pair of horizontal, adjoining, vertically-spaced load-bearing slabs of the building adjacent to an exterior edge of each of the slabs with moistureproof wall on a side of the frame proximal the exterior edge of each of the slabs.

* * * * *